United States Patent [19]

Toti

[11] Patent Number: 4,526,024

[45] Date of Patent: Jul. 2, 1985

[54] APPARATUS FOR FORMING ELONGATED SHEET METAL PANELS

[76] Inventor: Andrew J. Toti, 311 W. River Rd., Modesto, Calif. 95351

[21] Appl. No.: 396,609

[22] Filed: Jul. 9, 1982

[51] Int. Cl.[3] ..... B21B 1/08; B21B 27/02; B21D 13/04

[52] U.S. Cl. ..... 72/177; 72/181; 72/183; 72/205; 72/180; 29/125

[58] Field of Search ..... 72/176, 177, 181, 182, 72/183, 205, 237, 234, 366, 180; 29/123, 125

[56] References Cited

U.S. PATENT DOCUMENTS

| | | | |
|---|---|---|---|
| 104,647 | 6/1870 | Reynolds | 72/183 |
| 701,841 | 6/1902 | Chandler | 29/125 |
| 815,710 | 3/1906 | Johnson | 72/181 |
| 1,415,408 | 5/1922 | Scott | 72/179 |
| 1,927,501 | 9/1933 | Rafter | 72/181 |
| 2,105,240 | 1/1938 | Flagler | 72/181 |
| 2,370,702 | 3/1945 | Yoder | 72/177 |
| 2,450,987 | 10/1948 | Potter | 72/181 |
| 2,471,490 | 5/1949 | Mercer | 72/181 |
| 2,826,235 | 3/1958 | Gudmestad | 72/181 |
| 3,134,468 | 5/1964 | Toti | 189/37 |
| 3,224,154 | 12/1965 | Toti et al. | 52/520 |
| 3,292,402 | 12/1966 | O'Brien | 72/205 |
| 3,332,179 | 7/1967 | Toti | 52/90 |
| 3,485,076 | 12/1969 | Colburn | 72/179 |
| 3,509,753 | 5/1970 | Orth | 72/177 |
| 3,722,052 | 3/1973 | Toti | 29/155 |
| 3,741,593 | 6/1973 | Toti | 287/189.36 D |
| 3,789,563 | 2/1974 | Toti | 52/731 |
| 3,840,960 | 10/1974 | Toti | 29/200 B |
| 3,999,354 | 12/1976 | Anter et al. | 52/731 |
| 4,063,393 | 12/1977 | Toti | 52/245 |
| 4,114,247 | 9/1978 | Toti | 29/453 |
| 4,115,910 | 9/1978 | Hertel et al. | 29/125 |
| 4,251,973 | 2/1981 | Paik | 52/729 |
| 4,269,055 | 5/1981 | Sivachenko et al. | 72/181 |
| 4,286,451 | 9/1981 | Chang | 72/177 |
| 4,411,146 | 10/1983 | Sulasaari et al. | 72/181 |

FOREIGN PATENT DOCUMENTS

| | | | |
|---|---|---|---|
| 2740582 | 3/1978 | Fed. Rep. of Germany . | |
| 3020551 | 12/1981 | Fed. Rep. of Germany | 72/179 |
| 3022671 | 1/1982 | Fed. Rep. of Germany | 72/181 |
| 1197880 | 12/1959 | France | 72/177 |
| D. 51361 | 12/1980 | Luxembourg . | |
| 151212 | 12/1931 | Switzerland . | |
| 1080908 | 8/1967 | United Kingdom . | |
| 1590636 | 6/1981 | United Kingdom | 72/179 |
| 2081792 | 2/1982 | United Kingdom . | |
| 2074916 | 9/1983 | United Kingdom | 72/179 |

*Primary Examiner*—Daniel C. Crane

*Attorney, Agent, or Firm*—Flehr, Hohbach, Test, Albritton & Herbert

[57] ABSTRACT

Apparatus for forming a flat metal sheet into a panel having a central region of deep corrugations and a marginal edge which is either uncorrugated or has longitudinal or light traverse corrugations therein. A corrugation roll assembly forms the corrugated panel and a tension roll assembly pulls the panel through the corrugation roll assembly. A combination of cooperative corrugation roll sections and edge roll subassemblies are mounted on respective shafts with the edge roll subassembly providing a resilient gripping of an edge panel section in an angled channel region. This resilient gripping causes inward drawing of metal from the edge section into the corrugated central section to equalize the overall lengths of the respective sections.

10 Claims, 36 Drawing Figures

APPARATUS FOR FORMING ELONGATED SHEET METAL PANELS

This invention relates generally to metal forming methods and apparatus, to methods for interconnecting various metal elements such as separate sheet metal panels or sheet metal panels and extrusions without using separate fasteners, and to structural beam units and methods and apparatus for producing the same.

Light weight hollow metal building beams have been known generally in the art heretofor. Such prior art beams are shown in the following U.S. Pat. Nos.:

Toti et al. 3,134,468, issued 5/26/64; Toti et al. 3,224,154, issued 12/21/65; Toti 3,332,179, issued 7/25/67; Toti 3,722,052, issued 3/27/73; Toti 3,741,593, issued 6/26/73; Toti 3,789,563, issued 2/5/74; and Toti 3,840,960, issued 10/15/74.

Metal panel assembly structures and methods are also generally known in the art as characterized by the following U.S. Pat. Nos.:

Toti 4,063,393, issued 12/20/77 and Toti 4,114,247, issued 9/19/78. However, the respective beam assemblies and forming methods and apparatus and the structural panel assemblies and methods disclosed in the above-listed patents do not employ the improved features of the systems and methods of the present invention.

It is an object of this invention to provide improved hollow metal building beams and systems for making and assembling the same.

It is a further object of this invention to provide improved panel assembly methods and structures.

It is a specific object of this invention to provide an improved hollow metal beam utilizing a combination of extrusions and sheet metal panels and having greater structural strength and rigidity.

It is another object of this invention to provide an improved hollow metal building beam constructed entirely of sheet metal.

It is another object of this invention to provide a general method of securing metal components together with reduced tendency for longitudinal slippage between the components.

It is another object of this invention to provide an improved panel corrugation apparatus capable of producing straight corrugated panels having corrugated central sections and uncorrugated edge sections.

This and other objects of this invention together with the advantages of the various embodiments thereof will become apparent from a consideration of the following detailed disclosure in conection with the appended drawings.

Figure 1:
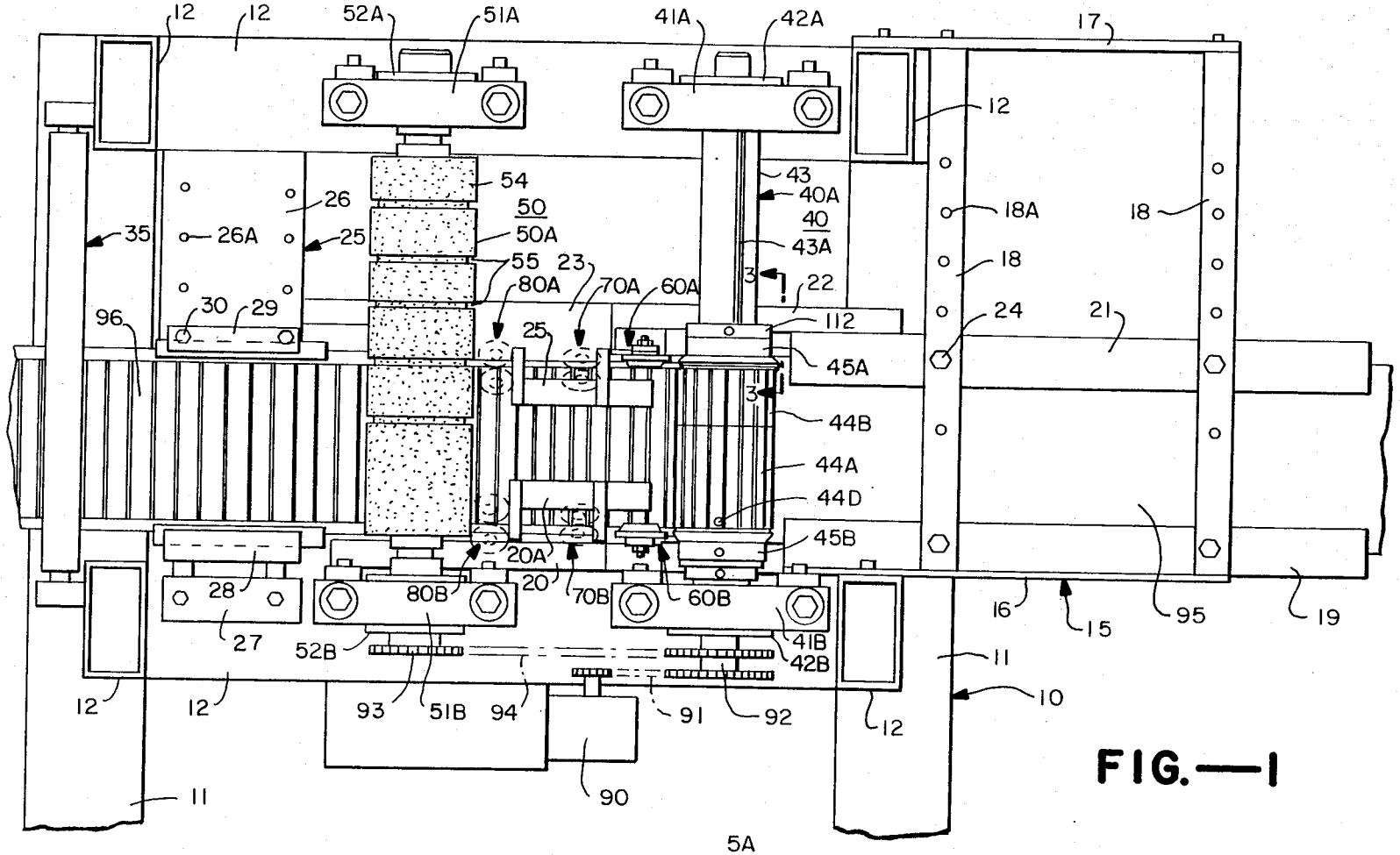
FIG. 1 is a partly sectioned elevational view of a panel corrugating apparatus in accordance with this invention.

Toti U.S. Pat. No. 3,840,960 generally discloses and suggests the use of a sheet metal panel in a structural beam assembly with transverse corrugations extending the entire width of the sheet metal panel. In practice, it has been found that it is only possible to corrugate the panel to a corrugation depth of about 0.070–0.090 inch since it is otherwise impossible to attach the edge of the corrugated side panel to a metal extrusion with the roller stitch technique disclosed in that patent or the compression seam technique disclosed in Toti U.S. Pat. No. 3,741,593. With deeper corrugation up to the edges of the sheet metal panel, the roller stitching or compression seaming process produces side wall distortion as the edge section of the metal panel is lengthened with respect to the central section during the stitching or seaming process. Such side panel distortion reduces the structural load bearing value of the beam and thus detracts from the improvement otherwise achieved with the corrugated side panel.

In accordance with this invention it has been discovered that it is possible to form a corrugated side panel with corrugations only in the central portion of the side panel and uncorrugated edges which have substantially the same overall length as the corrugated central panel section. This side panel makes it easy to use the roller stitch or compression seam technique for fastening the marginal edge portion of the side wall panel to the top and bottom extrusions. No side wall distortion results and the full benefit of the side wall corrugation to a depth of at least about 0.10 inch and preferable to about 0.140 to 0.160 is achieved. It has also been found of substantial value in accordance with this invention to provide cooperative transverse serrations on the edge of a shoulder forming ridge on the extrusion and a corresponding traversely serrated (or locally corrugated) step portion on the metal side panel with the respective serrations becoming cooperatively engaged as the side panel is fastened to the extrusion utilizing the roller stitch or compression seam method.

The ability of the method and apparatus of this invention to produce a deep corrugation in a central section of a sheet metal panel with substantially straight panel edge sections having no corrugation or only light corrugation therein to adjust edge section length and thus to produce a straight panel makes it possible to construct a very strong interlocking metal beam utilizing only sheet metal members. While beams of this general type have been disclosed in Toti et al. U.S. Pat. Nos. 3,134,468 and 3,224,154, such beams do not utilize the combination of corrugated side panels and cooperatively engaged transverse serrations to achieve a combined improvement in beam load bearing capacity.

Furthermore, it has been discovered that the use of cooperatively engaged transverse serrations is of substantial benefit generally in a variety of metal interconnection arrangements utilizing panels and extrusions and interconnecting individual panels utilizing roller stitch, compression seam, or hook and lock fastening arrangements which do not require any separate metal fasteners. Providing cooperatively engaged transverse serrations at locations where the sheet metal elements are urged in tight abutting relation with each other substantially precludes longitudinal movement between the interconnected elements and thus substantially increases the overall structural rigidity of the structural panel and extrusion assembly or the panel assembly.

Figure 8:
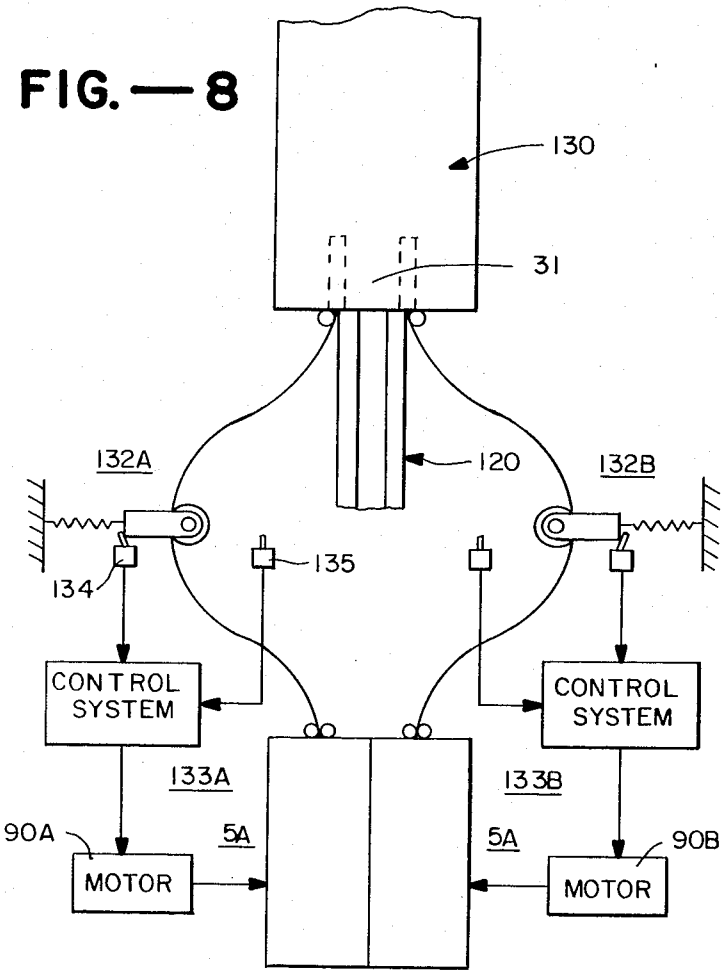
FIG. 8 is a schematic view of an improved overall structural beam forming system in accordance with this invention.

It has been found, for example, that the combination of the use of a deeply corrugated central side panel section in a structural beam assembly together with cooperatively engaged serrations on a step section of a transition region of the side panel and on a corresponding ridge on the extrusion produces a dramatic 15%–18% improvement in overall beam loading factor. Such a substantial improvement in the beam loading factor enables substantial cost savings to be achieved either by reducing the thickness of the side panel material to achieve the same overall beam strength with less material cost or by utilizing the same side panel material thickness and spacing the structural beams a greater distance apart. Either way a substantial cost saving is realized. The material cost saving can be achieved without any substantial additional manufacturing cost since, in accordance with this invention, substantially automated panel corrugation apparatus and beam assembly apparatus can be utilized to produce improved structural beams at high manufacturing volume and low cost. Such a manufacturing operation utilizes the side panel corrugation apparatus in accordance with this invention as disclosed in FIGS. 1–6 of the drawings together with a modified beam assembly machine of the type generally disclosed in Toti U.S. Pat. No. 3,840,960 to achieve an overall production facility shown schematically in FIG. 8 of the drawings.

Referring now to FIGS. 1–6, one embodiment of a panel corrugation apparatus in accordance with this invention be described. The main elements of panel corrugation apparatus in accordance with this invention are a mounting table structure 10, an inlet panel guide structure 15, an outlet panel guide structure 25, a corrugation roll assembly 40, a pull roll assembly 50 and various rotary edge forming die stations 60, 70 and 80, along with a motor and power train arrangement 90 for respectively driving the corrugation roll assembly 40 and the pull roll assembly 50.

The support table structure 10 includes vertical support legs 11 and upper and lower rectangular support frames comprised of horizontal support elements 12 attached to the vertical support legs 11. The inlet panel guide arrangement 15 includes a stationary bottom bracket 16 carrying a U-shaped panel guiding channel 19. A pair of vertical support bars 18 are mounted between the stationary bottom bracket 16 and a stationary upper bracket 17. A pattern of mounting holes 18A is provided in each of the vertical support members 18 to provide selectable registered mounting locations for an upper U-shaped panel guide 21 and a mounting bracket 22 which is fastened thereto and carries thereon an intermediate panel guide element 25 and a support structure 23 for the upper rotary die elements involved in rotary die stations 60, 70 and 80. In this manner the inlet panel guide assembly and the upper rotary die elements are all simultaneously adjustable in height to accommodate panel sections of varying widths.

A similar vertical adjustment is provided for the outlet panel edge guide 29 utilizing the mounting bolts 30 positioned in apertures 26A on a vertical support member 26. A stationary bracket 20 positioned intermediate the corrugation and roll assembly 40 and the pull roll assembly 80 is provided for mounting the lower rotary die elements for rotary die stations 60, 70 and 80 as well as the intermediate panel guide bracket 20A. A stationary mounting bracket 27 is utilized to mount the lower outlet panel edge guide 28 to a horizontal frame element 12.

Figure 2:
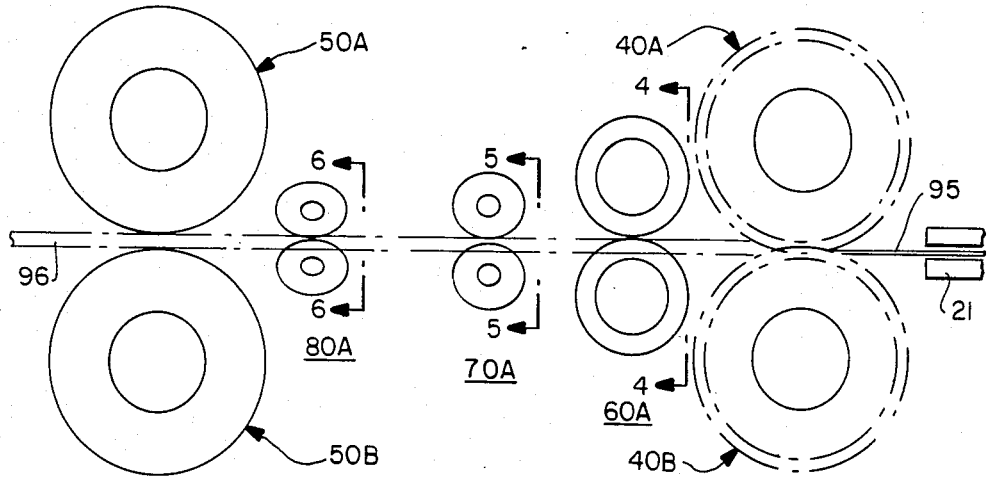
FIG. 2 is a generally schematic view illustrating the arrangement of major components of the panel corrugating apparatus of FIG. 1.
Figure 3:
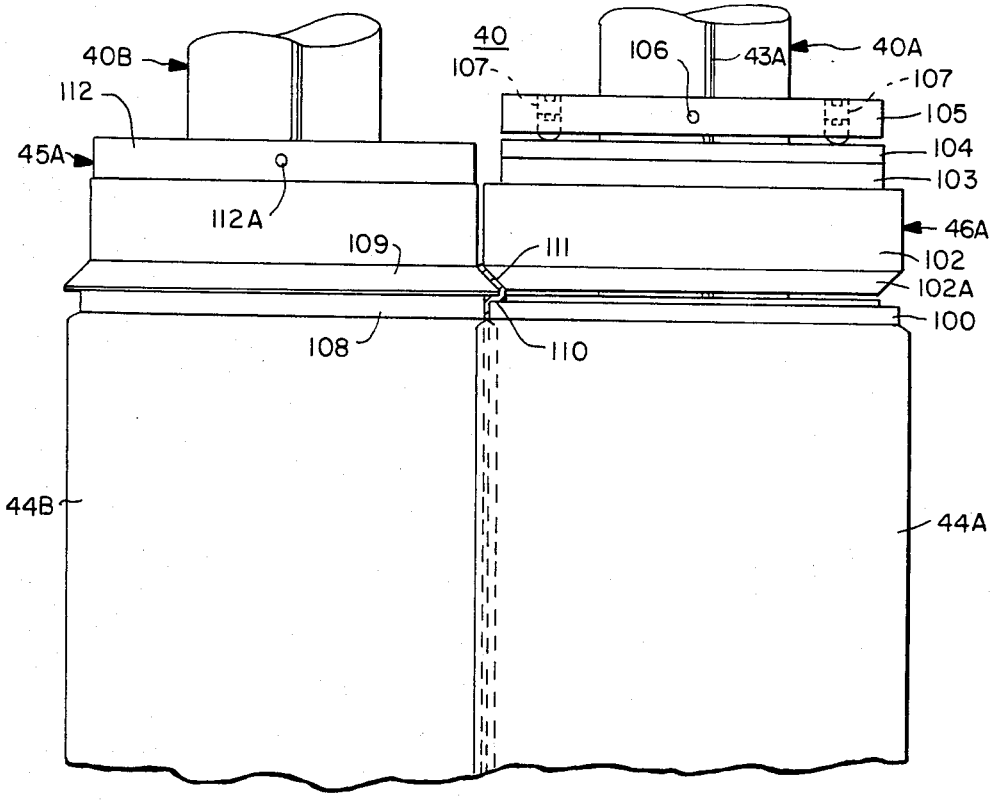
FIG. 3 is an elevational view of the corrugation roll assembly utilized in the apparatus of FIG. 1 and taken along the lines 3—3 shown in FIG. 1.

Referring now to FIGS. 1, 2 and 3 together, the corrugation roll assembly 40 includes a pair of complementary assemblies 40A and 40B, each of which is substantially identical in its structure and mounting arrangement with the exception of the edge roll assemblies 45 and 46 utilized thereon. Upper and lower bearing brackets 41A and 41B are bolted to upper and lower frame elements 12 for positioning a pair of upper shaft bearings 42A and lower shaft bearings 42B in a precise positional relationship for mounting the respective shafts 43 for rotation in a position which provides accurate partial engagement of the corrugation rolls 44A and 44B disposed on each shaft. Each of the pair of shafts has a longitudinal spline or key 43A which is received into corresponding keyways (not shown) in each of the corrugation and edge roll assemblies 44 and 45 mounted on the shaft 43. The details of the edge roll subassemblies 45A and 46A, 45B and 46B mounted on opposite ends of the corrugation rolls 44A and 44B shown in FIG. 1 will be discussed below in connection with FIG. 3.

FIG. 1 shows two separate corrugation roll sections 44A and 44B mounted on shaft 43 to generally depict the feature of building up the height of the corrugation roll using separate corrugation roll sections. Accordingly, adjustment of the machine to handle sheet metal panels of varying preselected standard panel widths is readily accomplished by adjusting the upper panel guide and bracket arrangement 21, the outlet bracket arrangment 25 and adding additional corrugation roll sections on the shaft 43.

Lower corrugation roll section 44A is pinned onto the shaft 43 utilizing a tapered pin 44D extending through this corrugation roll section and all the way through the shaft. The other corrugation roll sections 44B and any additional ones placed above it for corrugating panels of greater widths are simply resting on top of each other in seriatim order and confined in position by the edge roll assembly 45A. It will be appreciated that in extremely high volume production individual machines preset to separate panel widths may be provided and in this case the various vertical height adjustment features of this invention would not be employed.

FIG. 3 shows an enlarged view of the edge roll assemblies 45A and 46A and their respective mounting arrangements on the shafts 40A and 40B. Since the edge roll assemblies on the opposite side of the corrugation rolls 44A and 44C are identical, it is sufficient to describe only the subassembly shown in FIG. 3. The edge roll subassembly 46A includes edge roll 100 mounted on a shaft 40A adjacent the corrugation roll 44A and having a stepped edge configuration as shown. Edge roll 102 is positioned on the shaft 40A and the lower section 102A of the edge roll 102 has an angularly tapered circumferential surface thereon. Adjacent the edge roll 102 is a rubber washer element 103 which may be formed of either natural or synthetic rubber having a durometer value between sixty and seventy. Adjacent this rubber washer is a metal washer 104 whose inner diameter is preferably slightly larger than the outer diameter of the shaft to permit it to assume a disposition at slight angles to the shaft for purposes of accomplishing the resilient mounting feature to be described below. A metal collar 105 is mounted on the shaft in a fixed position utilizing a tapered pin 106 which extends through the shaft. Various registered vertical positions for the collar 105 are provided by registered holes through the shaft at its various mounting locations. Multiple pairs of tandum set screws 107A and 107B, having Allen wrench heads thereon, are provided for urging the metal washer 104 and the rubber washer 103 against the edge roll 102.

On the other shaft 40B, an edge roll assembly 45A is provided and is locked in position on the shaft utilizing a mounting collar 112 having a pin 112A extending through the collar and the shaft 40B. The edge roll 45A has a lower portion 108 with a straight circumferential outer surface thereon. Immediately adjacent the lower portion 108 is an intermediate portion 109 which has a tapered circumferential edge beginning at a point displaced from the edge of the lower portion 108. The tapered edge of the roll portion 109 has substantially the same angle as the tapered portion 102A on the edge roll 102 and forms an angular panel edge receiving channel 111 therebetween. The step portion 110 defined by the edge roll 100 and the lower portion 108 together with the intermediate portion 109 receives a transition portion of the marginal edge section of a sheet metal panel passing through the corrugation roll assembly.

It will be appreciated that as the Allen set screws 107A are tightened against the metal collar 104 the tapered surface 102A of the edge roll 102 is urged toward the tapered outer surface of the edge roll portion 109 for resiliently gripping the marginal edge section of a sheet metal panel received therebetween This resilient edge gripping function has been demonstrated to be of crucial importance to fabricating a corrugated panel section having a central corrugation section and an uncorrugated edge section with a transition region therebetween.

Various configurations of this resilient edge gripping edge roll arrangement could be provided including arrangements which eliminate the intermediate stair step 10 and begin the tapered edge holding section closer to the corrugation roll. The particular edge roll configuration depicted in FIG. 3 has special advantages for forming marginal edge portions of a centrally corrugated panel section to be utilized in a structural beam assembly as will be described below. The resilient angular gripping of the panel edge in the manner depicted in FIG. 3 facilitates the drawing in of metal from the edge section of a panel passing through the corrugation rolls 44A and 44C to effectively shorten the overall length of the marginal edge section of the panel to match the effective overall length of the corrugated central section. In this manner the uncorrugated marginal edge portion of the panel and the transition portion of the panel between the uncorrugated edge and the corrugated central portion have substantially no distortions therein would otherwise adversely affect the interfacing and interconnection of the marginal edge section with the extrusion in a overall structural beam assembly or other type of joining arrangement. Moreover, as will be discussed below, the capability to produce an uncorrugated panel edge with substantially deep corugations of about 0.140 inches in the central panel regions will provide an advantageous corrugated side panel to be utilized in a number of product applications in which a flat mounting edge is highly advantageous. This flat or uncorrugated mounting edge greatly simplifies the innerconnection of the panel with various other structural components to form beams or containers having all of the advantages of corrugated side walls and none of the problems associated with dealing with a corrugated edge for mounting and fastening purposes.

In the corrugation roll assembly 40 shown in the apparatus of FIG. 1, both edges of the metal panel section passing through the corrugation rolls and edge rolls of that assembly are held by the edge rolls at the marginal edge portion thereof to permit a carefully controlled inward draw of the metal into the transition portion and the corrugated central portion to equalize the overall lengths of those portions and thereby to preclude edge distortion which would otherwise be produced in simply corrugating a central section and leaving the edge section the same length. Since corrugation substantially shortens the central section, it will be appreciated that the edge section would have a substantial side-to-side distortion if it were the same length as the original incremental metal panel length. It has been found in practice that this inward drawing of the metal can be achieved with high accuracy and reproducibility even under conditions of slightly varying metal thickness (plus or minus 0.001 in metal sheets having a thickness of 0.025 to 0.125 inch) which are typically encountered in rolled continuous sheet metal products because of the resilient mounting arrangement provided by the combination of the metal washer 104 and the rubber washer 103. This resilient arrangement enables the gripping between the edge roll sections 102 and 109 to be a resilient gripping which automatically adjusts for metal thickness variations without substantially affecting the amount of inward metal draw. This enables reproducable forming of straight panel edge sections.

In practice, the positions of the Allen screws 107A are set to urge the metal washer 104 against the rubber washer 103 thereby to urge the edge roll 102 towards the opposing edge roll section 109 with an adjustable gripping force. This force is adjusted utilizing three or four separate sets of tandum Allen screws extending through the mounting collar 105. This provides locally variable amount of pressure to be applied at various circumferential positions to equalize out any localized variations in hardness of the rubber disc 103. The adjustment of the Allen screws is accomplished as a new sheet metal roll is introduced into the apparatus and the adjustment is varied until the edge section of the corrugated panel is substantially straight. Once this adjustment is made for a particular roll of sheet metal to be fed into the machine, it can be left in this adjustment for the entire corrugation process on that roll of sheet metal.

It should be apparent that the apparatus of this invention could also be utilized to corrugate all but one edge section of a sheet metal panel in the event that product applications for such a panel are found. This would be done by eliminating one of the edge roll assemblies.

Returning now to FIG. 1, pull roll assembly 50 utilizes the same general mounting arrangement as the corrugation roll assembly 40. Bearing mounting blocks 51A and 51B are provided for mounting the bearings 52A and 52B in which the shaft 53 is journaled for rotation. A resilient rubber roller 54 of the type utilized on conveyor belts and having a knobby gripping type surface is provided for gripping the corrugated metal panel passing therethrough. Circumferential grooves 55 are provided in the rubber roll 54 to accommodate the uncorrugated marginal edge portions of the corrugated panel 96 to avoid any distortion of the edge configuration.

The motor power train arrangement 90 includes an arrangement of gears and chains 91 for providing power to the shaft 43 of the corrugation roll assembly 40 with another gear and chain arrangement involving gears 92 and 93 and chain 94 transmitting power between the shaft 43 and the shaft 53. The gear wheel 93 is formed with a slightly smaller diameter and fewer teeth so that the pull roll assemblies 50A and 50B tend to rotate at a slightly higher speed than the corrugation roll assemblies 40A and 40B. This applies pulling pressure on the already corrugated panel and slightly elongates the corrugated central section of the panel to assists in neutralizing out any residual stresses in the corrugated section so that the final corrugated panel is very flat and straight.

This pulling and elongation function of the pull roll assembly 50 maintains the corrugated panel section tension between the corrugation roll assembly 40 and the pull roll assembly 50 and thus enables the use of rotary edge shaping die stations to fashion the configuration of the marginal edge section of the panel to an advantageous shape for the particular product application to which the panel will later be applied. Virtually any type of rotary edge shaping dies may be utilized between the corrugation roll assembly and the pull roll assembly. For example, it may be desired simply to straighten the marginal panel edge and eliminate the step portion intoduced by the offset in the angular edge gripping surfaces utilized in the edge roll arrangement depicted in FIG. 3. A simple one or two stage rotary straightening die arrangement could be mounted between the corrugation roll assembly 40 and the pull roll assembly 50 to accomplish this function.

Figure 4:
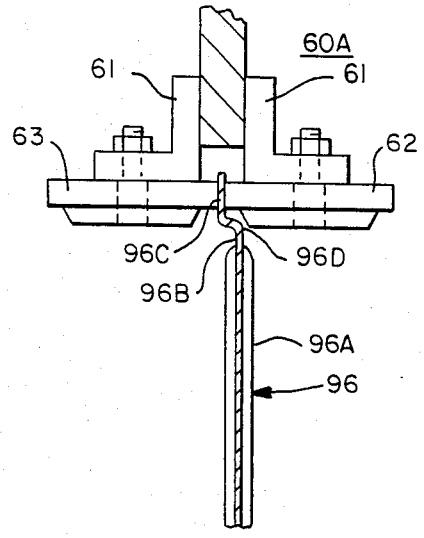
FIG. 4 is an elevational view of one rotary die forming stage of the corrugation apparatus shown in FIG. 1 taken along the lines 4—4 in FIG. 2.
Figure 5:
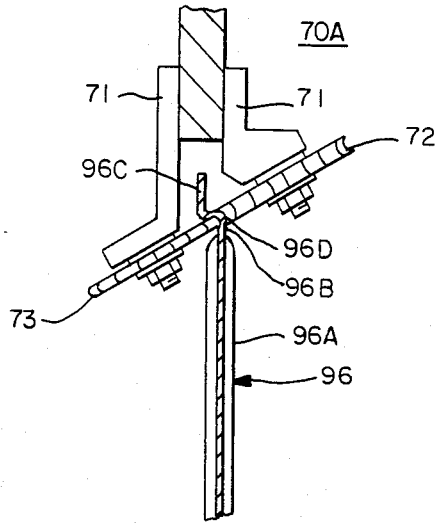
FIG. 5 is an elevational view of one portion of a second rotary die forming stage utilized in the apparatus of FIG. 1 and taken along the lines 5—5 in FIG. 2.
Figure 6:
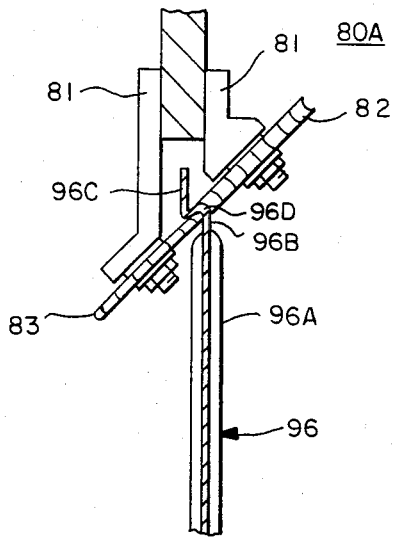
FIG. 6 is an elevational view of a third rotary die stage utilized in the apparatus of FIG. 1 and taken along the lines 6—6 shown in FIG. 2.
Figure 7:
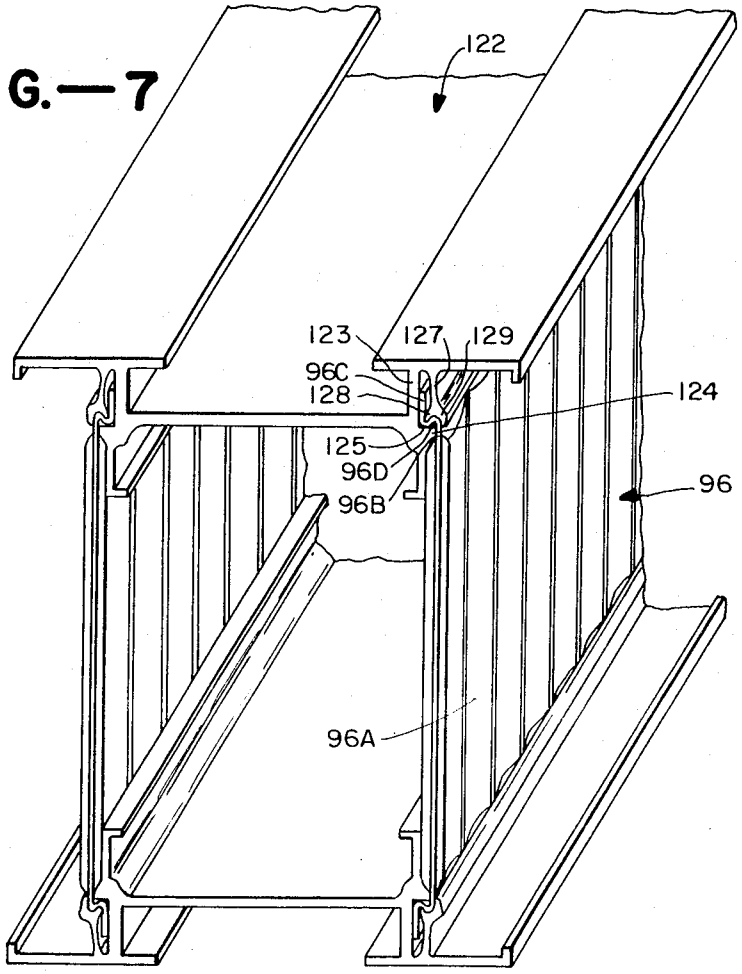
FIG. 7 is an isometric view of a structural beam assembly utilizing an improved compression seam fastening arrangement and improved corrugated side panel elements in accordance with this invention.

FIGS. 4–6 illustrate one arrangement of plural rotary edge shaping die stations which are particularly employed to configure the marginal edge section of panel 96 to have a prearranged shape and other advantageous characteristics for producing an improved compression seam beam arrangement as depicted in FIG. 7. The shape of the marginal edge portion of the corrugated panel 96 as the panel exits the corrugation roll assembly 40 is substantially the configuration of the edge roll subassembly shown in FIG. 3. The marginal edge section is bent at an angle generally corresponding to the angle of the corresponding edge roll arrangement shown in FIG. 3. Furthermore, the intermediate panel section retains the step introduced by the step configuration in the end rolls.

The first rotary die station 60A utilizes a pair of rotary edge straightening rolls 62 and 63 rotationally mounted on brackets 61. These straightening rolls 62 and 63 eliminate the reverse bend in the marginal edge section 96C. As shown in FIG. 5 the next rotary die station 70A utilizes a pair of serrating and shaping rolls 72 and 73 rotatably mounted on bracket 71 to contact the step portion 96D of the intermediate section 96B of panel 96 both to begin a shaping of the step region and to form a transverse serration pattern on the step region. In this die station, the forming and serration die 72 and 73 are angled at about thirty degrees to the horizontal.

Figure 6A:
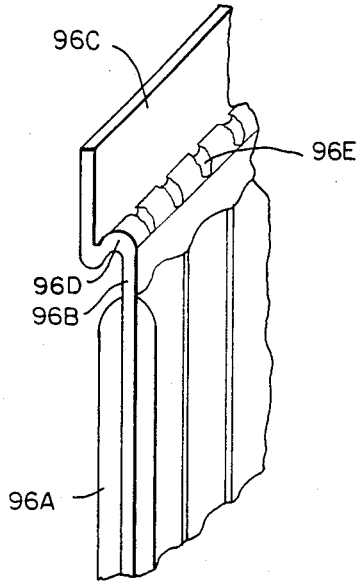
FIG. 6A is an isometric view of the structure of a corrugated and shaped sheet metal panel section after passing through the apparatus of FIG. 1.
Figure 11:
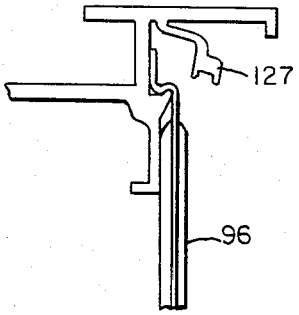
FIGS. 11–21 are fragmented, partial section views illustrating various structural beam assemblies and methods utilizing improved panel and extrusion interconnection systems in accordance with this invention.
Figure 12:
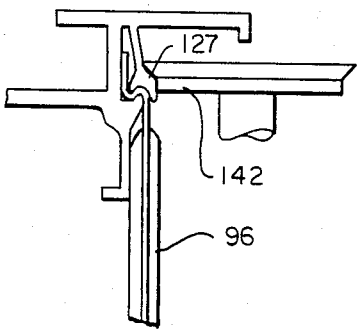

In the die station 80A shown in FIG. 6, additional serrating or corrugating dies 82 and 83 are rotationally mounted on brackets 81 and contact the same step portion 96D of the panel 96 for completing the transverse serration thereof as well as providing an additional rounding of the shape of the step section 96D. This shaping and transverse serrating operation forms the transition section 96B with its step region 96D to conform it to the shape of the ridge 124 with recessed shoulder 125 shown on the web portion 123 of the extrusion 122 depicted in FIG. 7. This same overall arrangement is shown in FIGS. 11 and 12. As will be discussed in more detail below the edge of the ridge portion 124 on the extrusion 122 has a transverse serration pattern formed thereon which will become cooperatively engaged with the transverse serration pattern on the step section 96D of the panel as a compression seam claw 127 is forced over the step section 96D and the ridge 124 in the compression seam fastening arrangement generally depicted in FIGS. 11 and 12. The transverse serration pattern formed on the step section 96D is shown as the serrations 96E in FIG. 6A. The serration pattern on the ridge 124 is depicted in FIG. 10.

The serrations on the ridge 124 have a greater pitch than the serrations on the step portion 96D of the panel in the embodiment shown, but the serrations become cooperatively engaged when the compression seam claw 127 is urged into tight engagement over the ridge 124. This cooperative engagement of the respective serrations substantially precludes any longitudinal movement between the extrusion 122 and the corrugated side panel 96. This similar arrangement is provided on all four ridges of the extrusion and, of course, is provided on all transition region step portions of the side panel so that the benefit of the reduced longitudinal slippage between the individual elements of the beam is achieved along the entire length of the beam.

Figures 9, 10:
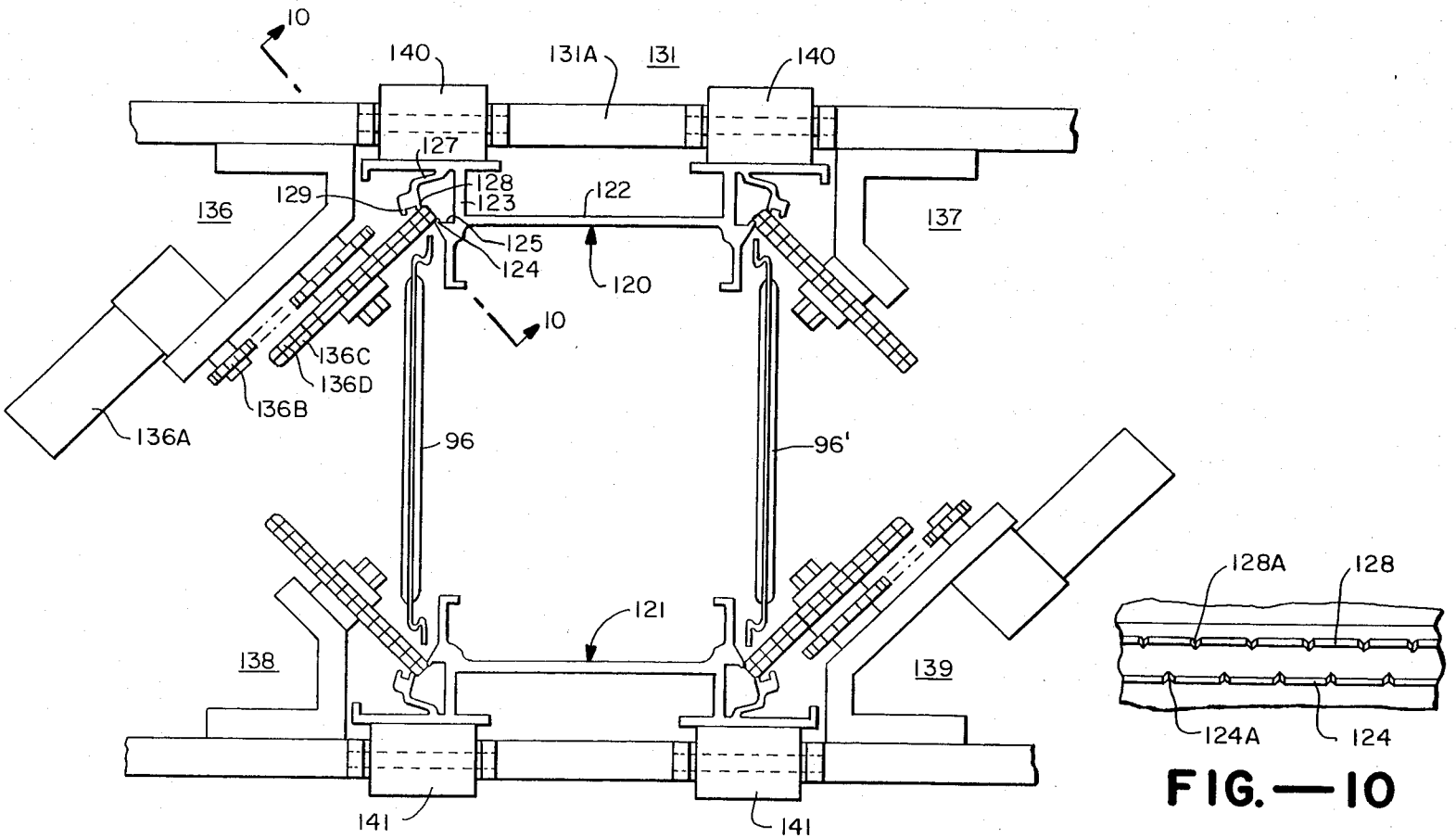
FIG. 9 is a partial section view illustrating a serration die station in the beam forming system of FIG. 8.
FIG. 10 is an enlarged view of the serration pattern produced by the serration die stage illustrated in FIG. 9.

As shown in FIGS. 9 and 10, both the ridge 124 and the inner finger 128 of the compression seam claw 127 are formed with transverse serrations thereon. Accordingly, cooperative engagement among three respective transverse serration patterns is provided to further tie the beam elements together and reduce the tendency for longitudinal motion or slippage therebetween. Utilizing the improved corrugated side panel 96 and the improved compression seam claw arrangement 127 with the cooperatively engaged transverse serrations at the locations described above, a structural beam assembly having 15% to 18% overall improvement in load bearing capacity is achieved. Both the deeper corrugated side wall having corrugations at least to a depth of about 0.140 inch and the cooperatively engaged, transversely serrated mounting surfaces cumulatively contribute to this improvement in load bearing capacity.

Figure 13:
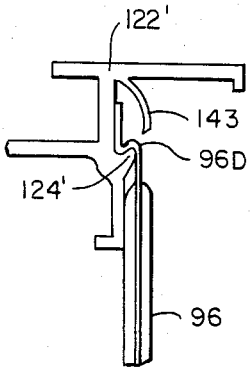
Figure 14:
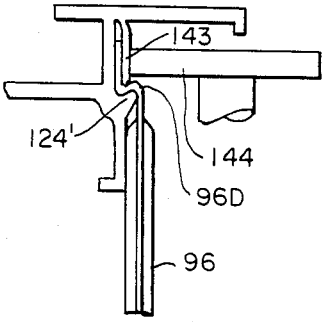

Similar, albeit slightly lower improvements in load bearing capacity of a hollow structural beam assembly could also be achieved utilizing the prior art compression seam arrangement depicted in FIGS. 13 and 14 which employs a compression seam arrangement with a single compression finger 143. Again the cooperatively engaged transverse serrations on the ridge 124' and the step section 96D of the panel 96 tend to resist any longitudinal motion between the extrusion 122' and the corrugated side panel 96. The compression seam fastening technique is discussed in detail in Toti U.S. Pat. No. 3,741,593 and that disclosure is hereby incorporated by reference herein.

Figure 15:
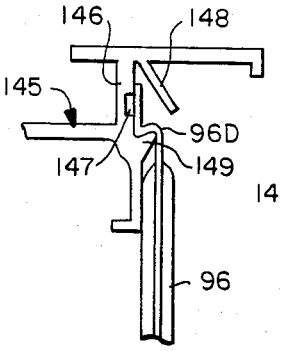
Figure 16:
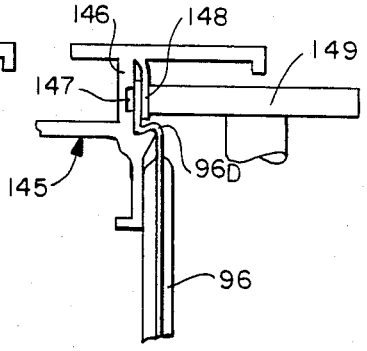
Figure 17:
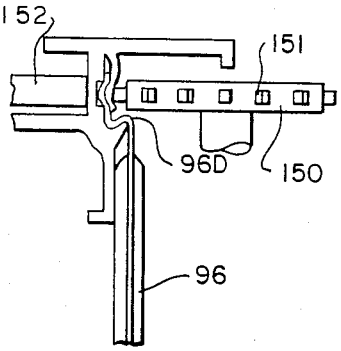

FIGS. 15–17 show schematically the use of the roller stitch method to fasten a corrugated side panel 96 to an aluminum extrusion 145. In this modification of the roller stitch fastening arrangement disclosed in Toti U.S. Pat. No. 3,840,960, a ridge 149 is provided adjacent the slot section 140 in the web 146 with the step portion 96D of the panel 96 fitting over the ridge 149 prior to closing of the outer wall portion 148 by the die 149 and formation of the roller stitch utilizing the riveting wheel and backing wheel 152. In this embodiment, the outer surface of the ridge 149 is also preferably formed with transverse serrations as is the step portion 96D of the panel 96 so that cooperatively engaged transverse serrations are provided to substantially preclude any longitudinal motion of the panel 96 with respect to the extrusion 145. It should be understood that any of the other roller stitch seaming methods disclosed in Toti U.S. Pat. No. 3,840,960 could also be employed with the corrugated panel and the transverse cooperatively engaged serration arrangement of this invention. The Toti U.S. Pat. No. 3,840,960 is incorporated herein by reference as a disclosure of alternative roller stitch seaming embodiments.

Referring back to FIG. 8, it will be seen that the panel corrugation apparatus of this invention may be coupled with the beam forming apparatus disclosed in Toti U.S. Pat. No. 3,840,960 to provide a semiautomated beam forming system. In the system shown in FIG. 8, separate panel corrugation machines 5A and 5B are provided for simultaneously corrugating left and right panel sections to be employed in the beam forming machine 130. Control systems 133A and 133B involving limit switches 134 and 135 may be utilized in connection with a panel tensioning and guide arrangements 132A and 132B to sequence the motors 90A and 90B of the panel corrugation machines 5A and 5B on and off so that the appropriate lengths of corrugated side panels will be available to the beam forming machine 130.

At an initial stage 131 of the beam forming machine 130, the top and bottom metal extrusions 121 and 122 are subjected to a rotary serration forming die stage 131 generally depicted in FIG. 9. The transverse serrations are formed on the ridge and inner claw of each of the sides of each of the top and bottom extrusions for later cooperative engagement with cooresponding transverse serrations on the step portions of the right and left panels 96 and 96' shown being fed into the beam forming machine along with the top and bottom extrusions 121 and 122. Four separate rotary serration forming assemblies 136–139 are provided at the serration forming die station 131. Each of the serration forming assemblies 136 and 139 are motor driven rotary die arrangement while the rotary serration assemblies 137 and 138 are idler die assemblies. The motorized rotary die assembly 136 will be described as exemplary of the motorized die assemblies and the idler die assemblies which are identical except for the provision of a power transmission linkage to a driving motor.

As shown the serration die assembly 136 includes a motor 136 and a power train arrangement 136B which drives a pair of serration forming gears 136C and 136D each of which are individually in tight pressure contact at outer teeth portions with the inner finger 128 of the compression seam claw arrangement 127 and the outer ridge 124 provided on web 123 of the upper extrusion 120. A pair of position rollers 140 enable the serration forming gears 136C and 136D to apply pressure to the inner claw finger 128 and the ridge 124 to form relatively deep serrations in the aluminum material of the extrusion. The pattern of serrations is shown in FIG. 10. Although a serration pattern with a smaller pitch could also be employed, it has been found sufficient to achieve the benefits of this invention to utilize serrations which are about one-half inch apart. Preferably, the serrations formed on the inner finger 128 of the claw 127 and the ridge 124 are offset with respect to each other. This appears to provide a preferred distribution of interengagement points between these serration patterns and the corresponding serration pattern on the step portion 96D of the metal side panel 96.

As previously indicated, the remaining portion of the beam forming machine 130 is substantially as disclosed in Toti U.S. Pat. No. 3,840,960, and involves bringing the top and bottom extrusions and the right and left side panel members together and then seaming the elements together utilizing appropriate forming dies at sequential die stations. The corrugating machine sections 5A and 5B are capable of operating at a throughput of up to about 70 feet per minute. The beam forming machine 130 operating with hand fed extrusion sections 120 and 121 is capable of operating at a speed of about 30 feet per minute. It is thus seen that the improvement in structural load bearing capacity of hollow metal beams provided in accordance with this invention can be achieved in a highly automated fashion at high production throughput rates and thus relatively low cost.

Figure 18:
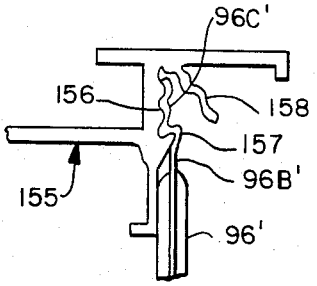
Figure 19:
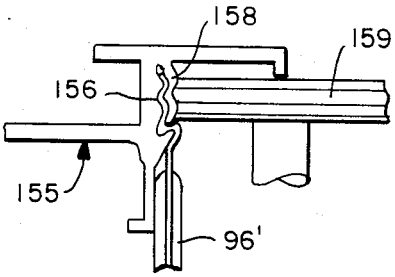
Figure 20:
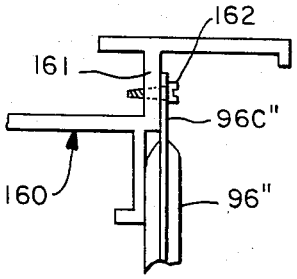
Figure 21:
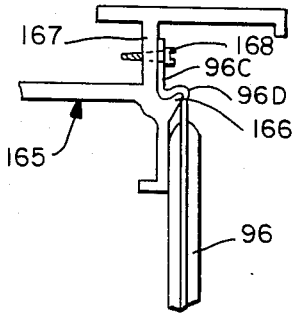

FIGS. 18 and 19 show an alternative form of a compression seam arrangement utilizing a ribbed longitudinal corrugation 96C' together with ribbed wall portions 156 and 158 on an extrusion 155. FIGS. 20 and 21 illustrate other embodiments in which the substantial benefits of a corrugated side panel could also be realized, utilizing separate fasteners instead of the compression seam or roller stitch fastening techniques. In the FIG. 20 embodiment, a separate machine screw 162 is utilized to mount the straight edge portion 96C" to the web 161 of an extrusion 160. It should also be understood that other fastening arrangements such as welding, riveting and the like could also be utilized. It should further be understood that the corrugated side panel 96" with a straight marginal edge section 96C" could also be utilized to provide corrugated side walls for trailer bodies and metal cargo carrying containers for ocean-going vessels, among other product applications. It is believed that the ability of the corrugation machine of this invention to provide a corrugated side panel having relatively deeply corrugated central sections and uncorrugated straight marginal edge sections will make corrugated side panels practical in a number of product applications not hitherto realized. In the FIG. 21 embodiment the combination of a separate metal fastener 168 and a ridge 166 on the extrusion 165 is provided to achieve the benefit of the cooperatively engaged serrations provided on the ridge 166 and the step portion 96D of the metal side panel.

Figure 22:
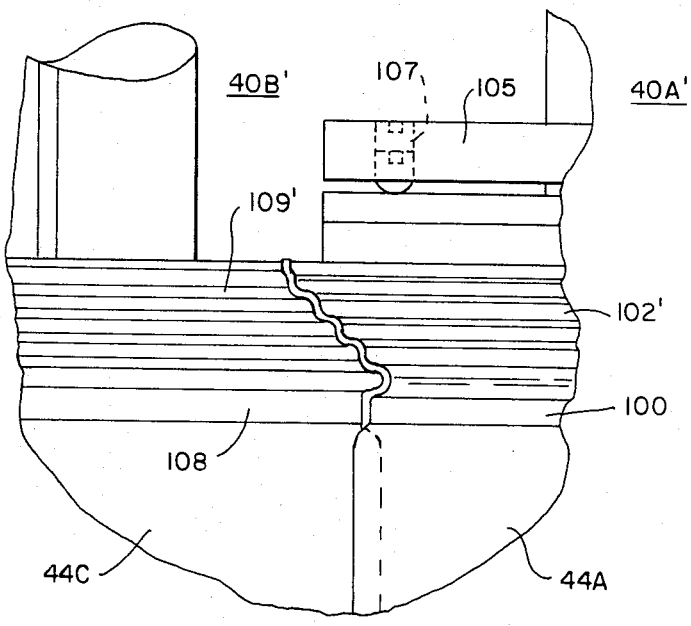
FIG. 22 is a fragmented, elevational view of an alternataive embodiment of a corrugation roll assembly in accordance with this invention.
Figure 23:
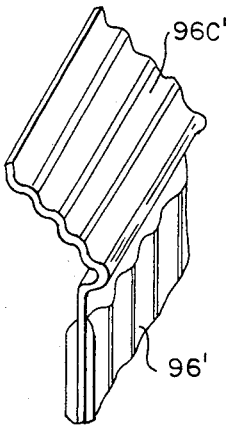
FIG. 23 is a fragmented, isometric view of a sheet metal panel formed in the corrugation roll assembly of FIG. 22.

FIG. 22 and 23 illustrate an alternative embodiment of an end roll arrangement for the panel corrugating apparatus of FIG. 1. In the FIG. 22 embodiment, the end roll portions 102" and 109" have longitudinal rib forming surface configurations for producing a light longitudinal corrugation of the edge portion of the sheet metal panel passing therethrough. In all other respects the end roll arrangement shown in FIG. 22 is substantially identical to that shown in FIG. 3. FIG. 23 illustrates the corrugation pattern on the edge section 96C" which is produced utilizing the edge roll arrangement of FIG. 22. Appropriate shaping and serrating rotary dies could be utilized to shape the marginal edge section 96C" to a configuration which makes it useful in the modified compression seam arrangement shown in FIG. 19.

Figure 24:
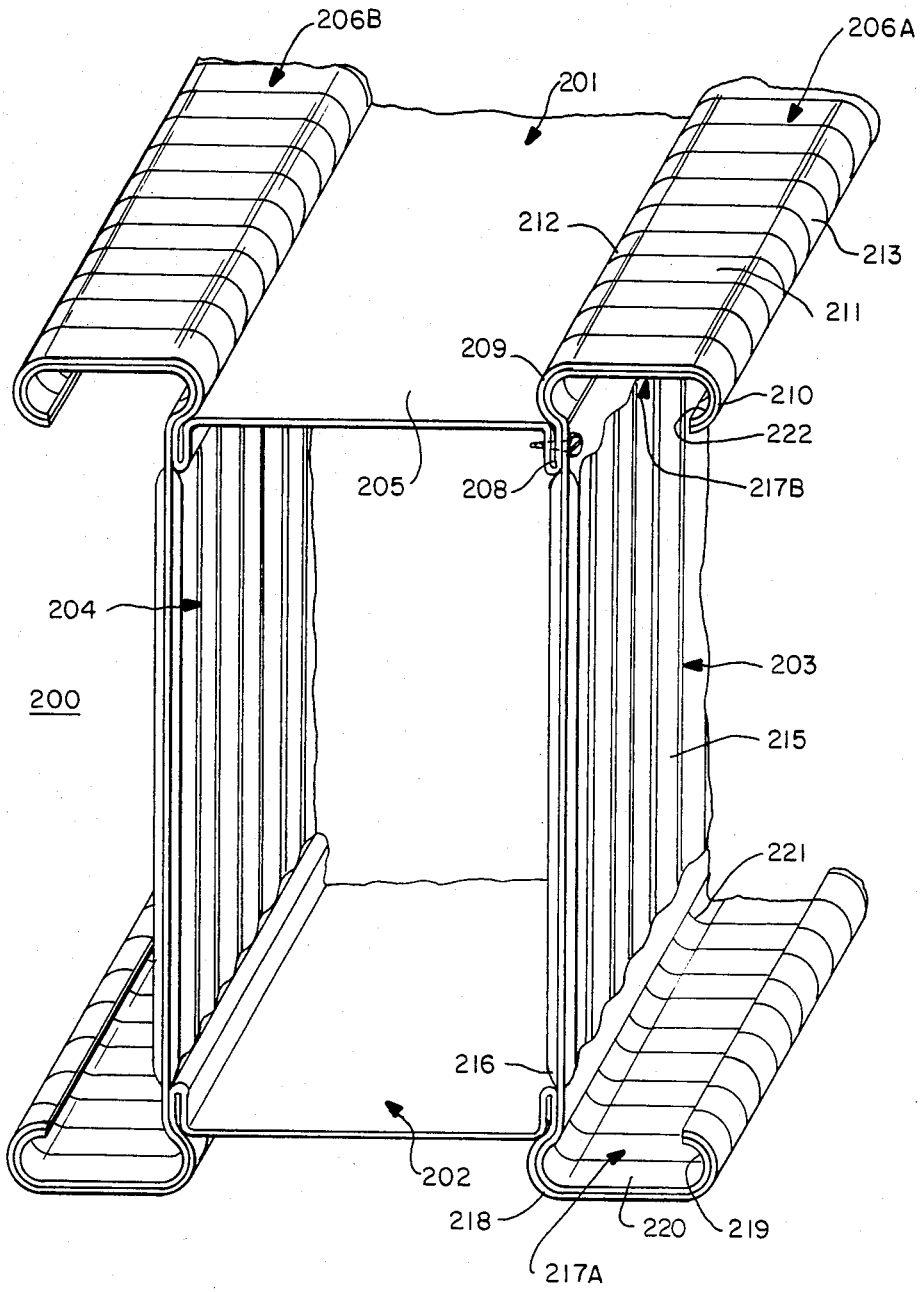
FIG. 24 is an isometric view of a structural beam assembly employing four sheet metal panel elements including a corrugated side panel in accordance with this invention.
Figure 33:
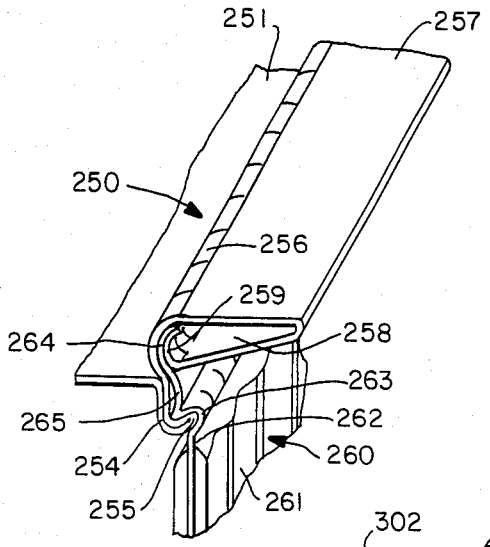
FIG. 33 is an isometric view of a modified beam panel interconnection system of the general type depicted in FIG. 24.

The general concepts of this invention may also be employed to fashion a completely new structural beam assembly utilizing only sheet metal components, preferably a thin gage (0.020 to 0.125 inch) of sheet steel or aluminum, to produce a very strong hollow beam which is readily susceptible of totally automated manufacture. FIG. 24 illustrates one embodiment of such a sheet metal beam structure and an alternative embodiment is shown in FIG. 33. The hollow beam structure shown in FIG. 24 utilizes complementary top and bottom preformed sheet metal panels 201 and 202 and complementary sheet metal side panels 203 and 204. The marginal edge portions of each of the top and bottom panels and the side panels are formed such that the respective marginal edge portions of the side panels interlock with corresponding marginal edge portions of the top and bottom panels in a hook and lock type fastening arrangement which secures the various panel elements together in a unitary, rigid, high strength, light weight assembly which is superior to any hollow structural beam unit previously produced.

Each of the complementary top and bottom panel elements 201 and 202 has a similar structure so only one will be described. Top panel element 201 includes a central web section 205 and a pair of marginal edge sections 206A and 206B which have identical although complementary preformed configurations, only one of which need be described. Adjacent the central panel section 205 is a double bend section 208, immediately above which is formed a first integral hook portion 209. On the extreme margin of the edge section 206A is formed a second integral hook 210 and the pair of hook portions 209 and 210 are separated by a base portion 211. The inner hook portion 209 and the outer hook portion 210 each has transverse serrations 212 and 213 formed therein.

Side panel 203 comprises a central corrugated section 215 and preformed marginal edge sections 217A and 217B. Each of these marginal edge sections is identical and, consequently, only one need be described. A transition portion 216 occurs between the central corrugated section 215 and the preformed marginal edge section 217A. An inner integral hook portion 218A is formed adjacent the transition section 216. At the outer edge of the marginal edge portion 217A is formed a second integral hook portion 219 with a base portion 220 extending therebetween. The base portion 220 has light transverse corrugations therein to assist in matching its overall length to the overall length of the central corrugated section 215. Similarly, each of the integral hook portions 218 and 219 has transverse serrations or corrugations therein which both assist in matching their overall length to the length of the central corrugated section and serve as cooperative engagement structures with the corresponding transverse serrations on the hook portions 209 and 210 of the top and bottom panel structures.

The pairs of integral hook portions 218 and 219 on each side panel element are cooperatively urged into tight abutting relation with cooresponding pairs of hook portions 209 and 210 on the top and bottom panels to interlock the structural elements together in a tight unitary structure with the cooperative engaging of the respective serrations on the hook portions substantially precluding longitudinal movement of the panel elements with respect to each other.

While other configurations for the central web portion 205 and the double bend portion 208 of the top and bottom panel elements respectively could be provided, it is believed that the double bend portion had substantial structural regidity to the overall beam and further serves as a ideal fastening point for fastening the beam to other structural elements.

Figure 25:
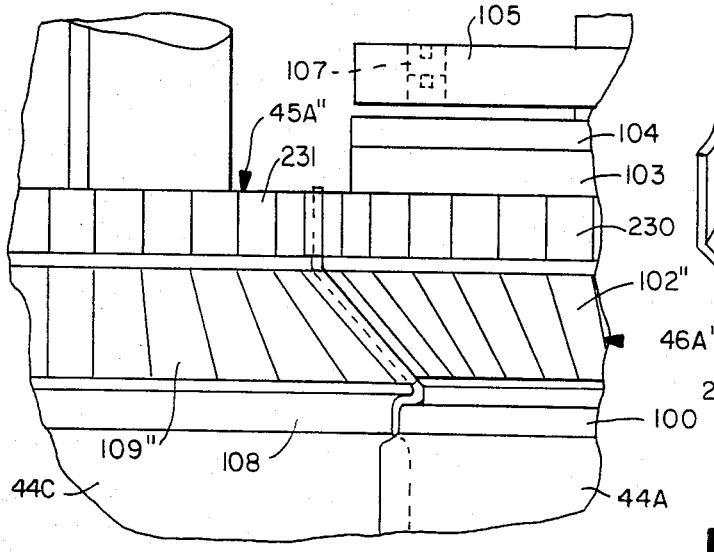
FIG. 25 is a partial view of an alternative embodiment of a corrugation roll assembly useful in producing a corrugated beam side panel structure as shown in FIG. 24.
Figure 29:
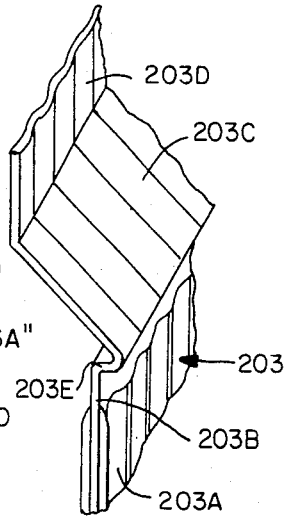
FIGS. 29–32 are fragmented isometric views of the marginal edge portion of the structural beam side panel after passing through the sequential corrugation and forming die stations depicted in FIGS. 25–28.

FIG. 25 shows a modified embodiment of the end roll assemblies 46A" and 45A" which may be utilized with the panel corrugating apparatus of FIG. 1 to do initial corrugating and forming operation on the marginal edge portions of the sheet metal panel to be utilized in the structural beam embodiment shown in FIG. 24. The end roll assembly 46A" includes the same first end roll 100 but utilizes an edge gripping roll 102" having a longer tapered surface with a transverse corrugating surface configuration which matches a corresponding transverse corrugating surface configuration on the roll portion 109" of the end roll assembly 45A". In addition, separate corrugation edge rolls 230 and 231 are provided adjacent the edge roll 102" and the edge roll 45A" to produce a transverse corrugation in an extreme marginal edge portion of a sheet metal panel passing through this corrugation roll assembly. The form of the sheet metal leaving this corrugation roll assembly is shown in FIG. 29 as a preformed panel 203 having a corrugated central section 203A, a transition section 203B, a first marginal edge portion 203C having light transverse corrugations thereon and a second edge portion 203D also having transverse corrugations thereon. A step portion 203E in the vacinity of the transition region 203B is also a part of the panel configuration at this stage.

Figure 26:
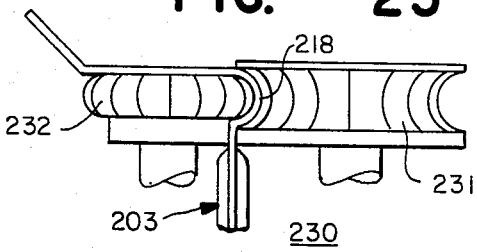
FIGS. 26–28 illustrates sequential rotary die stations which may be utilized for preforming the marginal edge portions of the corrugated side panels of the beam structure of FIG. 24.
Figure 30:
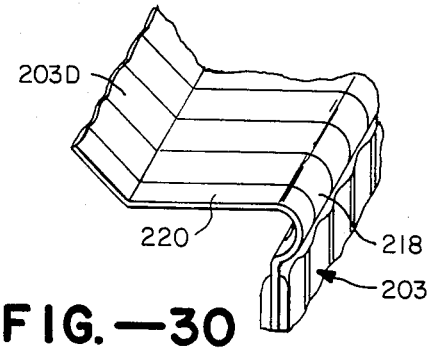

FIG. 26 schematically illustrates the use of a rotary die station 230 to both shape and serrate the panel section adjacent the transition region 203B into a first integral hook portion 218, utilizing a pair of shaping and serrating rollers 231 and 232. If necessary, more than one rotary die station could be provided to perform this function with intermediate shaping operations performed first and the rotary die station 230 doing being the final shaping operation. FIG. 30 illustrates the overall appearance of the preformed edge portion of the panel after this die forming operation and shows the first integral hook portion 218 and the adjacent base portion 220 in their essentially finished shape.

Figure 27:
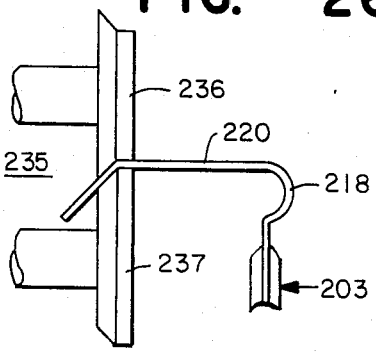
Figure 28:
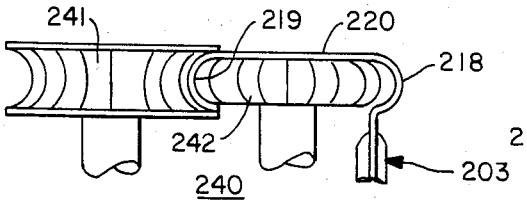

FIG. 27 illustrates a rotary die station 235 including rotary mounted dies 236 and 237 for bending the marginal edge section 203D into position for shaping in the rotary die station 240 illustrated in FIG. 28. Again a plurality of sequential rotary die stations may be provided to perform this bending operation if necessary and the individual rotary dies may have corrugated surface configurations as necessary to retain the corrugation profile of the edge portions contacted by the dies.

Figure 31:
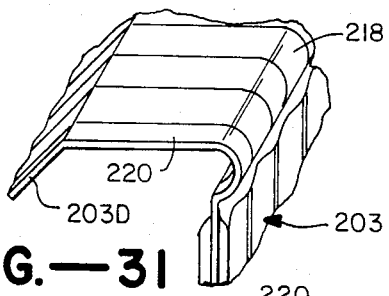

FIG. 31 illustrates the shape of the panel section after this bending operation by the rotary die station 235 has been performed to change the position of the outer marginal edge section 203D.

Figure 32:
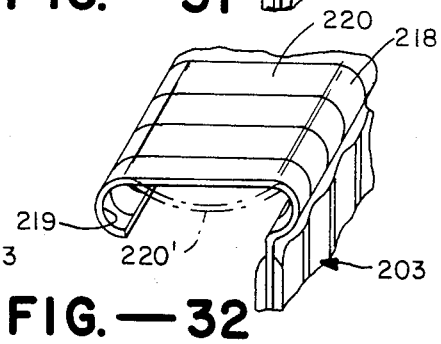

FIG. 28 illustrates a final rotary die station 240 for forming the integral hook portion 219 on the marginal edge portion utilizing rotary shaping and serration dies 241 and 242. FIG. 32 illustrates the final shape of the marginal edge portion of side panel 203 having a pair of integral hook portions 218 and 219 formed on opposite sides of the intermediate base portion 220. Preferably, the configuration of the base portion 220 would subsequently be changed to a slightly curved shape designated 220′ in FIG. 32 in another rotary die station before assembling into the beam structure. During the assembly operation the curved base section 220′ would be flattened by rollers to press the hook sections 218 and 219 tightly into engagement with corresponding hook sections 209 and 210 as shown in FIG. 24.

The rotary die stations 230, 235 and 240 depicted in FIGS. 26–28 could be located between the corrugation roll assembly 40 and the pull roll assembly 50 in the apparatus of FIG. 1 along with any other intermediate die stations which may be required. To accommodate the length of the preformed marginal edge portion of the strip which must pass through the pull rolls, relatively deep grooves would be provided in the pull rolls 54 at the locations to be traversed by the preformed marginal edge portions of the side panels. In all other respects the same corrugation apparatus as depicted in FIG. 1 may be utilized with the modifications shown in FIG. 25–28. This generally illustrates the flexibility of the corrugating apparatus of this invention to provide a variety of marginal edge configurations utilizing a combination of edge forming operations on the end rolls subassemblies of the corrugation roll assembly together with rotary shaping and/or serrating die stations intermediate the corrugation roll assembly and the pull roll assembly.

It will be apparent to persons skilled in the art of sheet metal forming that continuous roll forming of the top and bottom panels 201 and 202 shown in FIG. 24 could also be provided utilizing a plurality of rotary shaping and serrating die stations to sequentially form the various sections of the panel. It will also be apparent that a complementary pair of separate corrugation machines could be provided to form the side panels 203 and 204 and a second complementary pair of forming machines could be provided to form for the top and bottom panels 201 and 202 of the structural beam assembly depicted in FIG. 24. Continuous feed of the four preformed panel members into an automated beam assembling machine having generally the same structural and operational characteristics of the beam assembling machine disclosed in the Toti U.S. Pat. No. 3,840,960 could be utilized. Individual guiding and urging elements would be provided for guiding the individual integral hook portions of the side panels into the corresponding integral hook portions of the top and bottom panel sections in a continuous machine-assisted snap-in-place interlocking arrangement. Standard sheet metal cutting techniques could then be utilized on the output end of such a beam assembling machine to cut the beams to preselected lengths.

It should also be apparent to persons of skill in this art that relatively simple, hand operated tools could be utilized to assist in snapping the panel components of the structural beam shown in FIG. 24 into position in a field assembly operation. Moreover, a simplified beam forming machine could be provided for field operation and on-site assembly of the various panel sections into a unitary beam structure. The resulting lightweight and extremely strong, hollow structural beam would provide a large weight-to-strength benefit as well as a cost benefit in the construction industry. Because of the ready adaptation of the structural beam design of FIG. 24 to an automated production and assembly operation, both material and labor costs for producing the beam structure are low.

FIG. 33 illustrates an alternative embodiment of a structural beam assembly utilizing all sheet metal panel components. In this embodiment each of the top and bottom panel elements is represented by the element 250 and each of the side panel elements is represented by the panel 260. Top and bottom elements 250 include a double bend portion 254 which is formed into a integral hook portion 255. A second integral hook portion 256 is formed above the central web portion 251 and the marginal edge portion 258 is folded back creating a base region 257 and a third integral hook portion 259 which is wedged in tight compressive engagement against the second integral hook portion 256. Each of the hook portions 255, 256 and 259 has transverse serrations formed therein.

The side panel 260 includes a corrugated central section 261, a transition section 262 and a marginal edge section which includes a first integral hook portion 263 formed to match the configuration of the hook portion 255, a tongue portion 265 and an integral hook portion 264 formed on the extreme marginal edge. Each of the hook portions 263 and 264 has transverse serrations formed thereon. The transverse serrations on hook portion 263 are cooperatively engaged with the transverse serration on hook portion 255. The transverse serrations on hook portion 264 are cooperatively engaged with the serrations on both the hook portions 256 and 259. The hook portion 264 is wedged in a compression locking arrangement with the hook portions 256 and 259 and the hook portion 263 is snapped into tight engagement with the hook portion 255 during the beam assembly operation. The cooperatively engaged transverse serrations on each of the abutting hook portions substantially preclude longitudinal motion or slippage between the panel components. The end result is a hollow structural beam with high integrity and strength.

The marginal edge portions of each of the top and bottom panel sections and side panel sections of the embodiment shown in FIG. 33 can readily be formed in continuous rotary die forming operations. In particular, the die forming operations on the marginal edge portion of the side panel 260 could utilize substantially the edge roll subassembly configurations shown in FIG. 3 adding outer corrugation rolls above the relatively angled edge-holding surface roll portions 102A and 109. Suitable rotary shaping dies would be utilized between the corrugating roll assembly and the pull roll assembly to produce the marginal edge configuration depicted for the side panel 260 in FIG. 33.

Figure 34:
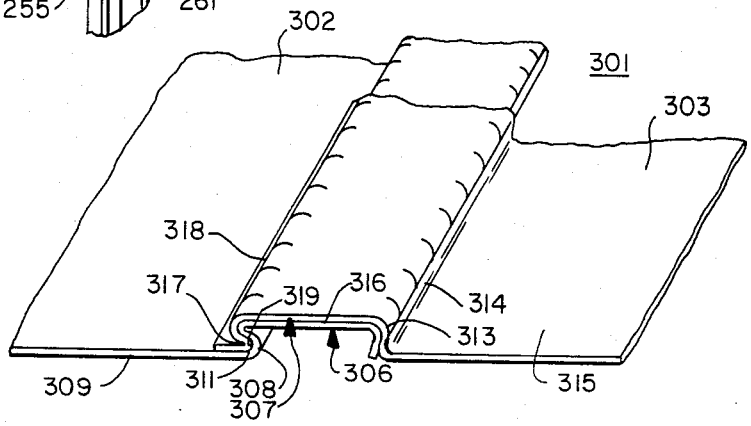
FIG. 34 is a fragmented isometric view of one embodiment of an improved sheet metal panel interconnection assembly and method in accordance with this invention.
Figure 35:
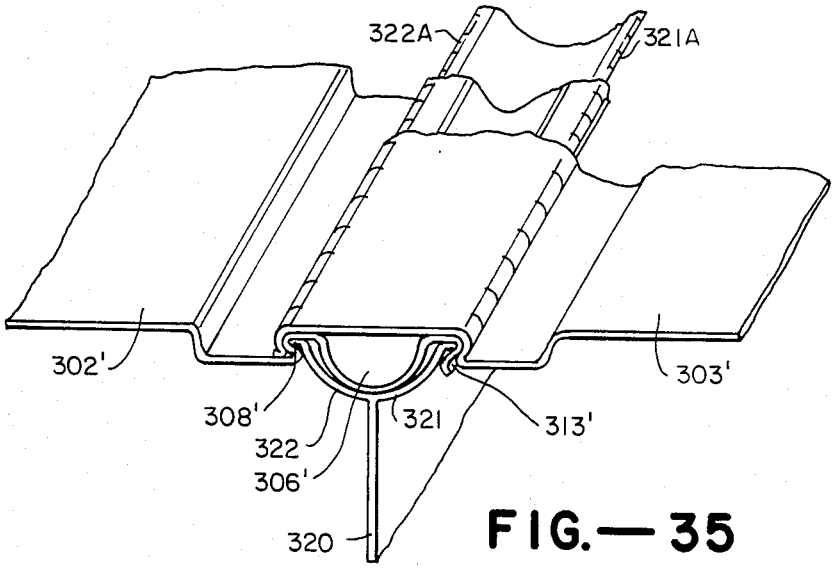
FIG. 35 is a fragmented isometric view of another embodiment of an improved sheet metal panel interconnection system in accordance with this invention.

FIGS. 34 and 35 illustrate that the important advantages of cooperatively engaged transverse serrations on abutting metal surfaces may also be utilized in other metal fastening arrangements, such as the two hook and lock panel fastening arrangements depicted in these Figures.

Referring to FIG. 34, a panel assembly structure, generally designated 301 and the procedure for assembling such a structure into an assembly joint without requiring special tools or separate fastening means to maintain the panels securely interconnected with each other is illustrated. The assembly structure 301 is defined by and comprises a pair of preformed panel members 302 and 303. Each panel is formed from a suitable metal or plastic material which possesses substantial rigidity coupled with resilience. Sheet aluminum has been found to be a highly effective material for forming the panels.

Each panel 302 and 303 is preformed to the configuration noted in FIG. 34 to include hook and snaplock connecting means which permits simple and rapid interconnection of the panels with each other into a secure panel assembly structure. In that regard, panel 302 includes an elongated generally flat deformable marginal tongue section 306 designed to be securely interfitted with a slotted marginal section 307 preformed in panel 303. To that end, tongue section 306 extends transversely of panel 302 and is defined by a reversely bent hook portion 308 which is integral with and overlies the main body portion 309 of panel 302. Hook portion 308 is connected with the panel body by a bent shoulder portion 311. Tongue 306 terminates in a edge section 313 which defines one end margin of panel 302.

The slotted marginal section 307 of co-operable preformed panel 303 includes an upstanding ridge 314 extending transversely of the panel which separates the main body portion 315 of the panel from the slotted marginal section 307. Ridge 313 includes a generally upright and generally rigid and unyielding abutment shoulder 314 which is interposed between the ridge and a generally flat base portion 316 of the slotted marginal section. The marginal section further includes a reversely bent hook portion 317 which overlies at least part of base 316. Hook portion 317 terminates in a generally flat edge portion 318 which defines a free edge of panel 303.

The reversely bent hook 308 of panel 2 is spaced from the main body portion 309 by a narrow channel 319 extending transversely of the panel. Hook portion 317 of panel 303 similarly is spaced from the base 316 of the slotted portion 307 by a narrow channel extending transversely thereof. The dimensions of the channels are determined in accordance with the relative thicknesses of the hook portion 308 and 317 so that a relatively snug fit exists therebetween when the panels are interengaged as shown.

Interengagement of the two preformed panels is rapidly and easily effected without requiring special tools by positioning hook 308 of panel 302 within and beneath hook 317 of panel 303. Thereafter, it is merely necessary to depress the tongue section 312 of panel 302 upwardly to bring edge section 313 thereof into secure snaplock engagement with the upright abutment 314 of panel 303.

Transverse cooperative serrations are formed on both of the hook portions 317 and 308 so that such transverse serrations are brought into cooperative abutting engagement when the hook portions are wedged together during the fastening process. Similarly, the edge section 313 and the abutment shoulder 314 have transverse serrations formed thereon which become cooperatively engaged when the tongue section 306 is snapped into the slotted marginal section 307 so that a tight fitting engagement is provided between the surfaces. These pairs of cooperatively engaged transverse serrations substantially preclude longitudinal movement between the panel sections 302 and 303 and thus provide a more rigid snap-lock connection between the two panels.

FIG. 35 discloses an alternative embodiment of a snap-lock panel assembly structure. However, in this case the tongue section 306' has a generally semicircular shape and a third fastening element 320 has resilient leg sections 321 and 322 urged into tight fitting engagement with the respect hook portions 308' and 313' of the panel section 302'. The end margins 321A and 322A of the leg sections 321 and 322 have transverse serrations thereon which cooperate with the transverse serrations on the hook portions 308' and 313' to substantially preclude longitudinal motion of the structural member 320 with respect to the panel member 302' in the snap-lock engagement region between the panels 302' and 303'.

Various other configurations of hook and snap-lock assembly arrangements for panel structures are disclosed in the Toti U.S. Pat. No. 4,063,393, which is hereby incorporated by reference. Each of the hook and snap-lock arrangements could beneficially utilize cooperatively engaged transverse serrations on each of the matching surfaces which are brought into tight engagement in the fastening arrangement.

Although the above description of various embodiments of the various features of this invention as applied to structural beam and panel assemblies and interlocking panel assemblies have been described for purposes of exemplifying the general principles of the invention, it should be understood that numerous changes could be made in the disclosed embodiments without departing from the principles of this invention. Reference is directed to the appended claims for the scope of protection to be afforded to the general inventive concepts disclosed herein.

What is claimed is:

1. Apparatus for forming an elongated sheet metal panel defined by a first portion including a major central portion having transverse corrugations formed therein, a transition portion adjacent said first portion and at least one marginal edge portion which has a configuration is either uncorrugated or has longitudinal corrugations or relatively light transverse corrugations therein with said transmission portion and said edge portion having substantially the same overall length as said first portion; said apparatus comprising a corrugation roll assembly receiving a flat sheet metal panel, a tension roll assembly downstream of said corrugation roll assembly for receiving said sheet metal panel after passing through said corrugation roll assembly, and power transmitting means for simultaneously driving said corrugation roll assembly at a first rotational velocity and said tension roll assembly at a second higher rotational velocity to provide a pulling force on said sheet metal panel between said corrugation roll assembly and said tension roll assembly, said corrugation roll assembly including first and second rotationally mounted shafts, first and second corrugation roll sections carried in interengaged manner on respective ones of said shafts and receiving said first portion of said panel for forming said transverse corrugations therein, and at least one edge roll subassembly carried on said shafts at one end of said corrugation roll sections, said edge roll subassembly including first and second edge rolls carried on said first and second shafts and having matching circumferential surface portions oriented at a substantial angle to the plane of said central panel section passing through said corrugation rolls and defining an angled panel receiving channel therebetween, and resilient mounting means for urging said edge rolls resiliently toward each other in a direction along the axis of a corresponding shaft to hold said portion of said edge panel section therebetween and thereby to cause an inward drawing of metal from said held portion of said edge panel section into said corrugated panel section for equalizing the overall lengths of said sections.

2. Apparatus as claimed in claim 1, wherein said edge roll subassembly further comprises a third edge roll carried on said second shaft, said first edge roll being carried on said first shaft abutting said corrugation roll section thereon, said third edge roll being carried on said second shaft and directly abutting said corrugation roll section thereon, and said second edge roll being carried on said second shaft outside said third edge roll; said third edge roll and a lower portion of said first edge roll defining a stepped panel receiving channel for creating a transition panel section having a step therein; a lower portion of said second edge roll and an intermediate portion of said first edge roll having complementary angled wall surfaces defining said angled panel receiving channel and being resiliently urged toward each other by said resilient mounting means to grip said portion of said panel passing therebetween.

3. Apparatus as claimed in claim 2, wherein said resilient mounting means comprises a steel collar fixedly mounted to said second shaft, a rubber washer carried on said second shaft adjacent said second edge roll, a metal washer carried on said second shaft adjacent said rubber washer, and a plurality of fastener means threaded through said steel collar and engaging said metal washer for urging said metal washer and said rubber washer resiliently against said second edge roll and thereby urging said angled wall surface of said second edge roll toward said angled wall surface of said first edge roll.

4. Apparatus as claimed in claim 1, wherein said first and second shafts of said corrugation roll assembly are substantially longer than the greatest sheet metal panel width to be corrugated, said first and second corrugation roll sections each comprise either one corrugation roll or plurality of separate corrugation rolls mounted in side-by-side relation on associated shafts in registered positions with respect to each other to provide a predetermined corrugation section width and said tension roll assembly comprises a pair of resilient surface rolls having circumferential grooves at prearranged locations corresponding to preselected locations of edge sections of corrugated panels having one of a series of corresponding predetermined panel widths.

5. Apparatus as claimed in claim 1, wherein said edge roll subassembly further includes a pair of corrugation roll assemblies located on said first and second shafts adjacent said angled surfaces of said first and second edge rolls for receiving and corrugating at least a marginal edge portion of said sheet metal panel.

6. Apparatus as claimed in claim 1, wherein at least a portion of said matching circumferential surface portions of said first and second edge rolls have interengaged corrugation forming surface configurations for producing a light transverse corrugation in the portion of said sheet metal panel passing therethrough.

7. Apparatus as claimed in claim 1, wherein at least a portion of said matching circumferential surface portions of said first and second edge rolls have a longitudinal rib forming surface configuration for producing a light longitudinal corrugation of the portion of said sheet metal panel passing therethrough.

8. Apparatus as claimed in claim 1, wherein rotary shaping die means are mounted between said corrugation roll assembly and said tension roll assembly in position to contact prearranged portions of one of both of said edge sections and said transition sections of said panel for shaping one or both said sections to prearranged configurations.

9. Apparatus as claimed in claim 3, adapted for forming an elongated sheet metal panel section which is adapted to be assembled with a connection member into a structural assembly joint wherein said connecting member includes a generally rigid web defining an integral shoulder; said corrugation roll section having a preselected length adapted to corrugate a central panel section including all but about a one-half inch marginal portion of sheet metal panel, and further comprising a plurality of rotary shaping die means mounted between said corrugation roll assembly and said tension roll assembly for forming said transition section and said edge section of said panel section into a step configuration substantially matching said shoulder of said ridge on said connection member.

10. Apparatus as claimed in claim 9, wherein said integral shoulder of said connection member has transverse serrations formed thereon and said rotary shaping die means includes at least one rotary die station for forming transverse serrations on a portion of said step portion of said panel such that said transverse serrations on said step portion of said panel are adapted to be urged into cooperative engagement with said transverse serrations on said shoulder when said step portion is mounted there against to substantially preclude longitudinal motion between said panel and said connection member.

* * * * *